US006502555B1

(12) United States Patent
Harcombe et al.

(10) Patent No.: US 6,502,555 B1
(45) Date of Patent: Jan. 7, 2003

(54) FUEL INJECTOR

(75) Inventors: Anthony Thomas Harcombe, Richmond; Robert Keith Cross, Banstead, both of (GB)

(73) Assignee: Delphi Technologies, Inc., Troy, MI (US)

( * ) Notice: Subject to any disclaimer, the term of this patent is extended or adjusted under 35 U.S.C. 154(b) by 22 days.

(21) Appl. No.: 09/648,932

(22) Filed: Aug. 25, 2000

(30) Foreign Application Priority Data

Aug. 28, 1999 (GB) ..... 9920352

(51) Int. Cl.[7] ..... F02M 37/04
(52) U.S. Cl. ..... 123/467; 239/96
(58) Field of Search ..... 123/467, 514, 123/506, 446–7; 239/88–96

(56) References Cited

U.S. PATENT DOCUMENTS 4,545,352 A * 10/1985 Jourde et al. ..... 123/467
5,522,364 A * 6/1996 Knight et al. ..... 123/467
5,680,988 A 10/1997 Patil et al. ..... 239/90
5,687,693 A * 11/1997 Chen et al. ..... 123/467
5,711,279 A * 1/1998 Green et al. ..... 123/506
5,954,033 A * 9/1999 Moncelle ..... 123/467
6,012,430 A * 1/2000 Cooke ..... 123/467
6,113,014 A * 9/2000 Coldren et a. ..... 239/88

FOREIGN PATENT DOCUMENTS

| | | |
|---|---|---|
| EP | 0987431 | 3/2000 |
| GB | 2320292 | 6/1998 |
| GB | 2330949 | 5/1999 |

* cited by examiner

*Primary Examiner*—Thomas N. Moulis
(74) *Attorney, Agent, or Firm*—Thomas N. Twomey

(57) ABSTRACT

A fuel injector for use in an injector arrangement includes a fuel pump having a pump chamber and a spill valve controlling communication between pump chamber and a low pressure reservoir. The injector includes a valve needle which is engageable with a valve needle seating, a control chamber arranged such that the fuel pressure therein urges the valve needle towards the valve needle seating. A control valve is provided for controlling the fuel pressure within the control chamber. An actuator arrangement is arranged to control the operation of the control valve such that, when the actuator arrangement is de-energised, the control valve permits communication between the control chamber and the low pressure reservoir.

14 Claims, 2 Drawing Sheets

FUEL INJECTOR

TECHNICAL FIELD

This invention relates to a fuel injector for use in supplying fuel, under pressure, to the cylinders of an internal combustion engine.

BACKGROUND OF THE INVENTION

A known fuel injector arrangement comprises a plunger reciprocable within a bore provided in a housing to pressurize fuel located within the bore. The bore communicates with a fuel pressure actuated injector such that once the fuel pressure within the bore exceeds a predetermined level, the injector opens and, thus, fuel injection commences.

In order to permit independent control of the injection pressure and the timing of injection, it is known to provide a spill valve which communicates with the bore, and an injection control valve which controls the pressure applied to a control chamber defined, in part, by a surface associated with a needle of the injector to control movement of the needle. In use, the spill valve remains open during initial inward movement of the plunger. Subsequently, the spill valve is closed, further inward movement of the plunger pressurizing the fuel within the bore. When injection is to commence, the injection control valve is actuated to connect the control chamber to a low pressure drain thus permitting movement of the needle away from its seating to commence fuel injection.

SUMMARY OF THE INVENTION

A known fuel injector of the aforementioned type includes a spill valve arrangement, which is controlled by means of a first actuator, and an injection control valve, which is controlled by means of a second actuator. A disadvantage of this type of injector is that, if the injection control valve fails to move from its lower seat, communication between the high pressure supply line and the control chamber cannot be broken and so fuel injection will not commence. The build up of high pressure fuel within the injector can cause damage to the components of the fuel injector, and to the fuel injector drive system.

It is an object of the invention to provide a fuel injector which alleviates this problem.

According to the present invention there is provided a fuel injector for use in an injector arrangement including a fuel pump having a pump chamber and a spill valve controlling communication between pump chamber and a low pressure reservoir, the injector including a valve needle which is engageable with a valve needle seating, a control chamber arranged such that the fuel pressure therein urges the valve needle towards the valve needle seating, a control valve controlling the fuel pressure within the control chamber and an actuator arrangement controlling the operation of the control valve, wherein, when the actuator is de-energised, the control valve permits communication between the control chamber and the low pressure reservoir.

Preferably, the control valve comprises a valve member which is engageable with first and second valve seatings to control communication between the pump chamber and the control chamber and between the control chamber and the low pressure reservoir respectively. The valve member is preferably resiliently biased into a position in which it engages the first valve seating, energisation of the actuator arrangement causing movement of the valve member away from the first valve seating to break communication between the control chamber and the low pressure reservoir.

Such an arrangement is advantageous in that, if the control valve fails and the valve member becomes stuck in a de-actuated position, the valve member engages the first valve seating and the control chamber communicates with the low pressure reservoir. In such circumstances, the fuel pressure will be able to lift the valve needle away from its seating, avoiding the generation of excessive pressures within the injector and reducing the risk of damage to the injector and the associated fuel injector drive mechanism.

The spill valve and the control valve may be actuated independently by a single electromagnetic actuator. This provides the advantage that fewer electrical connections to the fuel injector are required than where the valves are controlled by independent actuators.

The injector may include a first housing part provided with a bore within which the control valve member is reciprocable, the first valve seating being defined by the bore. The second valve seating may be defined by an end surface of a second housing part in abutment with the first housing part.

Alternatively, both the first and second valve seatings may be defined by end surfaces of first and second housing parts.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
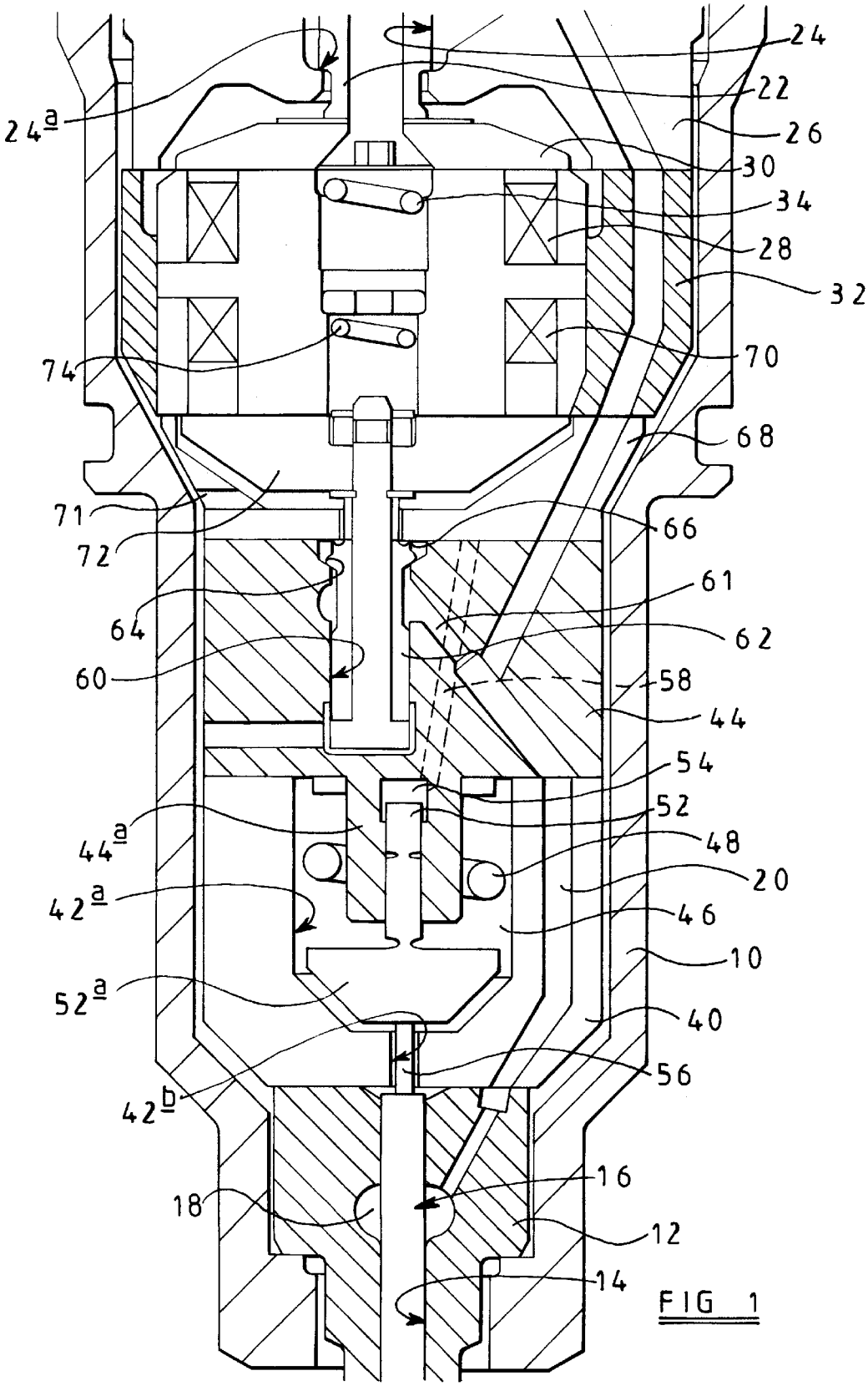
FIG. 1 is a sectional view of a part of a fuel injector in accordance with an embodiment of the invention.

Referring to FIG. 1, the fuel injector comprises a nozzle body 12 which is provided with a bore 14 within which a valve needle 16 is reciprocable. The bore 14 includes an enlarged diameter region which defines an annular chamber 18 for fuel, fuel being supplied to the annular chamber 18 and the bore 14 through a supply passage 20 defined by drillings provided in the nozzle body 12 and in various housing parts, to be described hereinafter, the housing parts and the nozzle body 12 being located within a cap nut 10. The valve needle 16 is engageable with a seating in order to control fuel delivery through one or more outlet openings (not shown) provided in the nozzle body 12.

The injector further includes a pump unit (not shown) comprising a plunger which is reciprocable within a plunger bore under the action of a cam arrangement, a return spring being provided in order to withdraw the plunger from the plunger bore. The plunger bore communicates with a spill valve arrangement which includes a spill valve member 22 which is engageable with a seating to control communication between the plunger bore and a low pressure reservoir or drain. The spill valve member 22 is slidable within a bore 24 provided in a housing part 26. The supply passage 20 permits fuel to flow from the plunger bore to the annular chamber 18 and the bore 14, fuel within the bore 14 acting against appropriately orientated thrust surfaces (not shown) of the valve needle 16 to urge the needle 16 away from its seating provided in the nozzle body 12.

Movement of the spill valve member 22 is controlled by means of an electromagnetic actuator arrangement including a first actuator 28, the armature 30 of which is connected to the valve member 22. The actuator 28 is located within a housing part 32. The valve member 22 is engageable with a seating 24*a* defined by part of the bore 24 such that, when the valve member 22 engages the seating 24*a* communication between the plunger bore and the low pressure reservoir is not permitted. A spring 34 is located so as to bias the valve member 22 towards a position in which the valve member 22 is lifted away from its seating 24*a*, energization of the actuator 30 moving the valve member 22 against the action of the spring 34 and into engagement with the seating 24*a* to break communication between the plunger bore and a low pressure reservoir.

The nozzle body 12 abuts a distance piece 40 provided with a through bore, including a region of relatively large diameter 42*a* and a region of smaller diameter 42*b*, the through bore being coaxial with the bore 14 provided in the nozzle body 12. A housing part 44 abuts the end of the distance piece 40 remote from the nozzle body 12, the housing part 44 including a projection 44*a* which extends within the enlarged diameter region 42*a* of the bore, the projection 44*a* of the housing part 44 and the region 42*a* of the through bore in the distance piece 40 together defining a spring chamber 46 within which a spring 48 is located.

The projection 44*a* includes a blind bore 50 within which a piston member 52 is slidable, the bore 50 and an end face of the piston member 52 together defining a control chamber 54 for fuel. The piston member 52 includes an enlarged end region 52*a* which is connected to or abuts a load transmitting member 56, the load transmitting member 56 being connected, at its other end, to the valve needle 16 such that movement of the piston member 52 within the bore 50 is transmitted to the valve needle 16. The end region 52*a* of the piston member 52 abuts the spring 48, the spring 48 thereby serving to bias the piston member 52, and the valve needle 16, in a downwards direction, thereby urging the valve needle 16 against the seating provided in the nozzle body 12.

The control chamber 54 communicates with a passage 58 provided in the housing part 44, the passage 58 communicating, at its other end, with a bore 60 provided in the housing part 44, the bore 60 communicating with a passage 61 provided in the housing part 44 which communicates with the supply passage 20. A control valve arrangement is provided in the housing part 44, the arrangement including a control valve member 62 which is slidable within the bore 60 and is engageable with first and second valve seatings 64, 66 respectively to control communication between the supply passage 20 and the control chamber 54, via passages 61, 58 and the bore 60, and between the control chamber 54 and a low pressure reservoir for fuel (not shown). The first valve seating 64 is defined by a part of the bore 60 provided in the housing part 44 and the second valve seating 66 is defined by an end surface of a housing part 68 in abutment with the end of the housing part 44 remote from the distance piece 40. The flow of fuel to the low pressure reservoir occurs, in use, through a clearance between the valve member 62 and a bore formed in the housing part 68, a chamber housing the armature 72 (described below) and a drain passage 71.

The valve member 62 is slidable within the bore 60 under the control of a second actuator 70 which includes an armature 72 which is connected to the valve member 62. The actuator 70 is housed within the housing part 32 in a position vertically below the actuator 28 for the spill valve member 22. A spring 74 is located so as to bias the control valve member 62 towards a position in which the valve member 62 is seated against the first seating 64. Thus, in use, when the actuator 70 is de-energized, the valve member 62 is seated against the first seating 64 and communication between the passage 61 and the passage 58 is broken such that fuel is unable to flow from the supply passage 20 into the control chamber 54 via the passages 61, 58. In such circumstances, the valve member 62 is spaced from the second seating 66 and the control chamber 54 therefore communicates with the low pressure reservoir.

When the actuator 70 is energised, the armature 72 moves the control valve member 62 against the action of the spring 74 away from the first seating 64 and into engagement with the second seating 66. In this position, the communication between the passage 58 and the low pressure reservoir is broken, fuel within supply passage 20 being able to flow, via the passage 61, past the first seating 64, into the passage 58 and into the control chamber 54. As a result, fuel pressure within the control chamber 54 is substantially equal to that within the supply passage 20. It will be appreciated that in such circumstances, the force acting on the valve needle 16 urging the valve needle 16 into engagement with its seating due to the fuel pressure within the control chamber 54 and due to the action of the spring 48 is increased, and the effective areas of the piston member 52 and the valve needle thrust surfaces are chosen so that the forces urge the valve needle 16 into engagement with its seating. The valve needle 16 therefore occupies a position in which it engages its seating and, in such circumstances, fuel injection through the outlet openings does not take place.

In use, with the plunger bore charged with fuel, and starting from a position in which the plunger is in its outermost position within the plunger bore and the actuators 28, 70 are de-energised, the spill valve member 22 is biased away from the seating 24*a* by the spring 74 such that the plunger bore communicates with the low pressure reservoir. Additionally, the valve member 62 is in engagement with the first valve seating 64 such that the passage 58 communicates with the low pressure reservoir. In such circumstances, the valve needle 16 engages its seating under the action of the spring 48 and fuel injection does not take place. FIG. 1 shows the fuel injector during this stage of operation.

From this position, the plunger commences inward movement into the plunger bore, such movement resulting in fuel being displaced through the spill valve arrangement to the low pressure reservoir. When it is determined that pressurization of the fuel within the plunger bore should commence, firstly the actuator 70 is energised such that the control valve member 62 moves away from the first valve seating 64 into engagement with the second valve seating 66. Thus, communication between the control chamber 54 and the low pressure fuel reservoir is broken, fuel within the supply passage 20 being supplied to the control chamber 54 through the passage 61, past the first valve seating 64 and through the passage 58. Secondly, the actuator 28 for the spill valve member 22 is also energized, resulting in movement of the valve member 22 against the seating 24*a* to break communication between the plunger bore and the low pressure reservoir.

It will be appreciated that continued inward movement of the plunger within the plunger bore therefore results in the pressure of fuel within the plunger bore, and the supply passage 20, increasing. Thus, relatively high pressure fuel is supplied through the supply passage 20 to the chamber 18 and the bore 14 provided in the nozzle body 12. The pressure of fuel applied to the thrust surfaces of the valve needle 16 is therefore increased. However, as the control valve member 62 is seated against the second valve seating 66, communication between the control chamber 54 and the supply passage 20 ensures that a sufficiently high force is applied to the piston member 52 and the valve needle 16 due to fuel pressure within the control chamber 54 which, combined with the spring force due to the spring 48, maintains engagement between the valve needle 16 and its seating. Thus, fuel injection does not take place during this stage of operation.

When fuel pressurization within the plunger bore has increased to a sufficiently high level, and fuel injection is to be commenced, the actuator 70 is de-energized, and the control valve member 62 moves away from the second valve seating 66, against the action of the spring 74, into engagement with the first valve seating 64. Such movement of the valve member 62 breaks communication between the control chamber 54 and the supply passage 20 and instead permits communication between the control chamber 54 and the low pressure reservoir. Fuel pressure within the control chamber 54 is therefore reduced which results in a reduction in the force urging the valve needle 16 into engagement with its seating. A point will be reached at which the force applied to the thrust surfaces of the valve needle 16 due to high fuel pressure within the bore 14 is sufficient to overcome the action of the spring 48 and the reduced fuel pressure within the control chamber 54. The valve needle 16 then lifts away from its seating to permit fuel to flow past the valve needle seating provided in the nozzle body 12 and through the outlet openings to commence fuel injection.

In order to terminate fuel injection, the actuator 28 is de-energized such that the armature 30 and spill valve member 22 return under the action of the spring 34, with the spill valve member 22 lifted away from the seating 24*a*. Fuel within the plunger bore is therefore able to flow to the low pressure reservoir such that fuel pressure within the supply passage 20 and the bore 14 is reduced. With the control valve member 62 seated against the first seating surface 64, a point will be reached when the force applied to the piston member 52 and the valve needle 16 due to fuel pressure within the control chamber 54 combined with the force due to the spring 48 is sufficient to overcome the reduced fuel pressure acting on the thrust surfaces of the valve needle 16 such that the valve needle 16 returns to its seated position. In such circumstances, fuel delivery does not occur through the outlet openings and fuel injection ceases.

Alternatively, fuel injection may be terminated by re-energising the actuator 70 such that the armature 72 moves the control valve member 62 away from the first valve seating 64 into engagement with the second seating 66 to re-establish communication between the supply passage 20 and the control chamber 54. The force applied to the piston member 52 and the valve needle 16 due to fuel pressure within the control chamber 54, combined with the force due to the spring 48, is sufficient to overcome the fuel pressure acting on the thrust surfaces of the valve needle 16 and the valve needle 16 is therefore returned against its seating to cease fuel injection. At or after termination of injection, the actuator 28 is de-energised and the spill valve member 22 moves under the action of the spring 34 to a position in which the plunger bore communicates with the low pressure reservoir causing fuel pressure within the plunger bore to be reduced. Continued inward movement of the plunger within the plunger bore results in further fuel being displaced through the spill valve arrangement to the low pressure reservoir. With the plunger bore open to low pressure, the actuator 70 is then de-energised to move the control valve member 62 away from the second valve seating 66 into engagement with the first valve seating 64 such that the control chamber 54 also communicates with the low pressure reservoir.

The fuel injector of the present invention is advantageous in that, if the control valve arrangement fails, the control valve member 62 will remain seated against the first seating 64 under the action of the spring 74, the control chamber 54 thereby remaining in communication with the low pressure reservoir. As fuel pressure increases within the bore 14 provided in the nozzle body 12, a point will be reached when the force applied to the thrust surfaces of the valve needle 16 is sufficient to overcome the force applied to the piston member 52 and the valve needle 16 due to the relatively low fuel pressure within the control chamber 54, combined with the spring force due to the spring 48, and the valve needle 16 will lift away from its seating. Although this may lead to fuel injection at an advanced stage of the fuel injection cycle, and may lead to increased fuel delivery, as the control chamber 54 remains in communication with the low pressure fuel reservoir in such circumstances, the fuel injector components and the drive mechanism will not be damaged.

Figure 2:
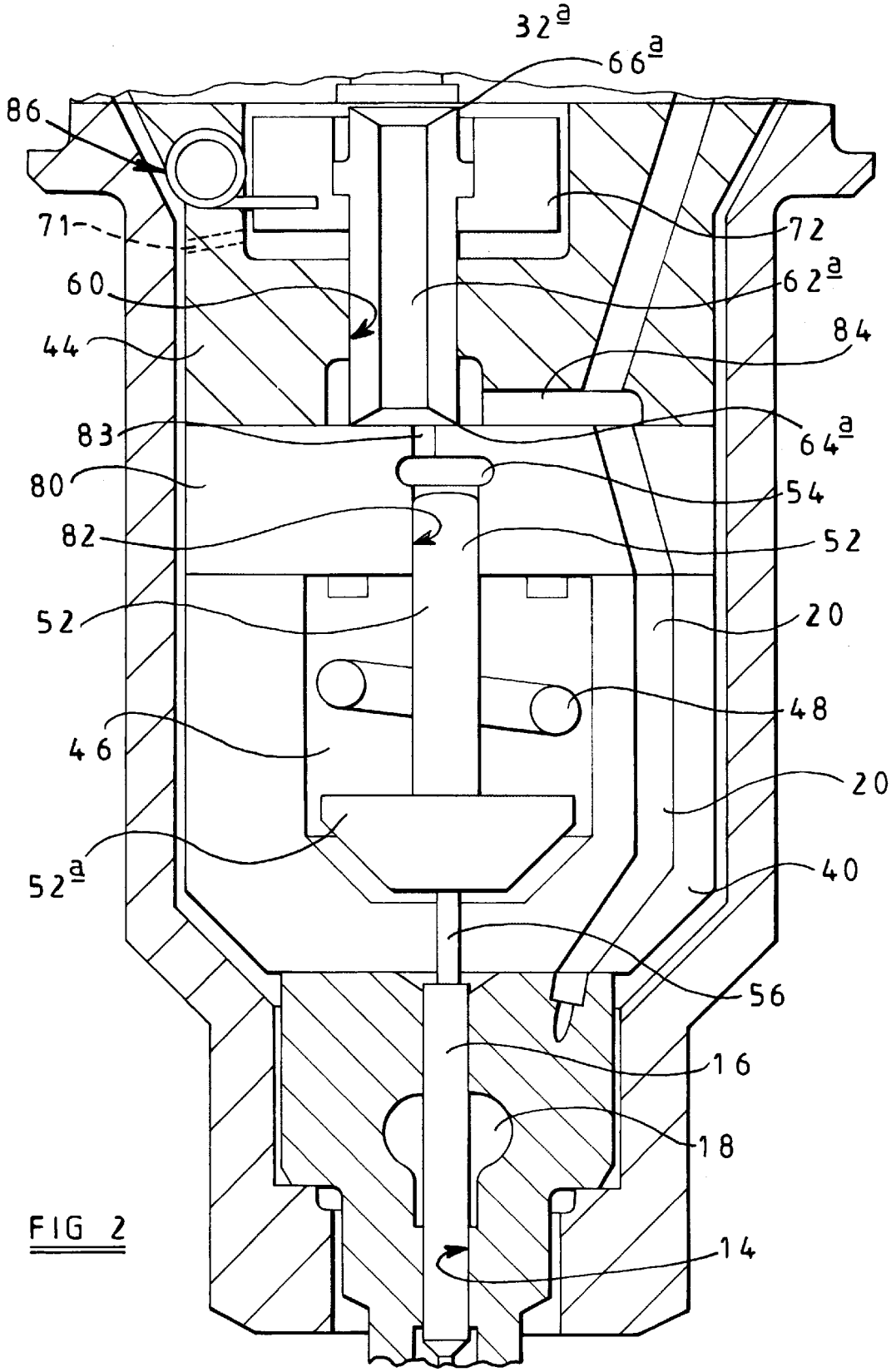
FIG. 2 is a sectional view of a part of a fuel injector in accordance with an alternative embodiment.

An alternative embodiment of the invention is shown in FIG. 2, which includes an additional housing part 80 located between the distance piece 40 and the housing part 44. In addition, the housing part 68 is removed, the housing part 44 being in abutment with the housing part 32. First and second valve seatings 64*a*, 66*a* are defined by the upper end surface of the housing part 80 and the lower end surface of a plate 32*a*carried by the stator of the actuator 70, respectively, the control valve member 62*a* being of tubular form and being shaped to define end surfaces which are engageable with the first and second valve seatings 64*a*, 66*a* to control communication between the control chamber 54 and the supply passage 20 and the control chamber 54 and the low pressure reservoir.

The housing part 80 is provided with a bore 82 which includes a region of enlarged diameter which defines the control chamber 54, the piston member 52 being reciprocable within the bore 82 and exposed to fuel pressure within the control chamber 54, as described previously. The housing part 80 is also provided with a drilling defining a passage 83 which permits communication between the control chamber 54 and the bore 60.

The housing part 44 is provided with a recess or groove which defines, together with the upper end surface of the housing part 80, a passage 84 which communicates with the supply passage 20 such that, with the control valve member 62*a* lifted away from the first valve seating 64*a* and engaging the second seating 66*a*, fuel within the supply passage 20 is able to flow, via the passages 84, 83 and the bore 60, into the control chamber 54. The engagement of the valve member 62*a* with the second seating 66*a* prevents fuel from flowing from the control chamber 54 to the low pressure reservoir. A spring 86 is located to bias the armature 72 of the actuator 70 into a position in which the control valve member 62*a* is seated against the first valve seating 64A, one end of the spring engaging the armature 72 and the other end of the spring engaging the outer housing 10.

With the control valve member 62*a* in engagement with the first valve seating 64*a*, communication between the supply passage 20 and the control chamber 54 is broken. In such circumstances, the valve member 62*a* is lifted away from the second valve seating 66*a* such that the control chamber 54 communicates with the low pressure reservoir via the tubular passage defined by the valve member 62*a*.

Operation of the fuel injector in FIG. 2 occurs in substantially the same way as described hereinbefore with reference to FIG. 1. During operation, if the actuator 70 fails, the control valve member 62*a* will remain seated against the first valve seating 64*a* under the force of the spring 86 until the force due to fuel pressure within the bore 14, acting on the thrust surfaces of the valve needle 16, exceeds the force due to fuel pressure within the control chamber 54 acting on the piston member, combined with the spring force due to spring 48, to lift the valve needle 16 away from its seating. Fuel injection will than take place. As described previously, fuel injection may therefore occur early in the injection cycle, and with an increased fuel delivery. However, as the default position of the control valve member 62*a* is one in which fuel is able to escape from the control chamber 54 to the low pressure reservoir, damage of the fuel injector components and the fuel injector drive system is avoided.

What is claimed is:

1. A fuel injector for use in an injector arrangement including a fuel pump having a pump chamber and a spill valve controlling communication between pump chamber and a low pressure reservoir, the injector including a valve needle which is engageable with a valve needle seating, a control chamber for fuel arranged such that fuel pressurization of the control chamber therein urges the valve needle towards the valve needle seating, a control valve for selectively pressurizing and depressurizing the control chamber and an actuator arrangement for controlling the operation of the control valve, whereby, when the actuator arrangement is de-energised, the control valve isolates the control chamber from communication with the pump chamber and permits communication between the control chamber and the low pressure reservoir to depressurize the control chamber and when the actuator arrangement is energised, the control valve isolates the control chamber from communication with the low pressure reservoir and permits communication between the control chamber and the pump chamber.

2. The fuel injector as claimed in claim 1, wherein the control valve comprises a control valve member which is engageable with first and second valve seatings to control communication between the pump chamber and the control chamber and between the control chamber and the low pressure reservoir respectively.

3. The fuel injector as claimed in claim 2, wherein the control valve member is resiliently biased into a position in which it engages the first valve seating, energisation of the actuator arrangement causing movement of the control valve member away from the first valve seating to break communication between the control chamber and the low pressure reservoir.

4. The fuel injector as claimed in claim 1, wherein the fuel injector comprises a single electromagnetic actuator arrangement for actuating the spill valve and the control valve independently.

5. The fuel injector as claimed in claim 2 , wherein the injector includes a first housing part provided with a first bore within which the control valve member is reciprocable, the first valve seating being defined by the first bore.

6. The fuel injector as claimed in claim 5, wherein the second valve seating is defined by an end surface of a second housing part in abutment with the first housing part.

7. The fuel injector as claimed in claim 2, wherein the first and second valve seatings are defined by end surfaces of first and second housing parts respectively.

8. The fuel injector as claimed in claim 7, wherein the control valve includes a control valve member of tubular form, the control valve member defining a flow passage for fuel through which fuel flows, in use, between the control chamber and the low pressure reservoir when the control valve member is lifted away from the second valve seating.

9. The fuel injector as claimed in claim 2, further comprising a biasing arrangement for urging the control valve member into engagement with the first valve seating.

10. The fuel injector as claimed in claim 9, wherein the biasing arrangement comprises a spring which acts directly on the control valve member to urge the control valve member into engagement with the first valve seating.

11. The fuel injector as claimed in claim 9, wherein the actuator arrangement comprises an armature which acts on the control valve member and wherein the biasing arrangement comprises a spring which acts on the armature so as to urge the control valve member into engagement with the first valve seating.

12. The fuel injector as claimed in claim 1, further comprising a piston member which is movable with the valve needle, a surface of the piston member being exposed to fuel pressure within the control chamber.

13. The fuel injector as claimed in claim 1 further including a biasing member biasing the valve needle into engagement with the valve needle seating, and wherein the control chamber is oriented to further bias the valve needle into engagement with the valve needle seating when the control chamber is pressurized.

14. The fuel injector as claimed in claim 13 wherein when the control valve is selectively positioned to pressurize the control chamber with pressurized fuel from the pump chamber the valve needle is unseated from the valve needle seat at a first fuel pressure, and when the control valve is selectively positioned to depressurize the control chamber the valve needle is unseated from the valve needle seat at a second fuel pressure, the second fuel pressure being less than the first fuel pressure.

* * * * *